US010245193B2

(12) United States Patent
Gingras et al.

(10) Patent No.: US 10,245,193 B2
(45) Date of Patent: Apr. 2, 2019

(54) BRAKE SYSTEM FOR WHEELCHAIR

(71) Applicant: MOTION COMPOSITES INC., Saint-Roch-de-l'Achigan (CA)

(72) Inventors: David Gingras, L'Assomption (CA); Pierre-Andre Couture, Montreal (CA); Michael Archambault, Saint-Roch-de-l'Achigan (CA)

(73) Assignee: MOTION COMPOSITES INC., Saint-Roch-de-l'Achigan (CA)

( * ) Notice: Subject to any disclaimer, the term of this patent is extended or adjusted under 35 U.S.C. 154(b) by 0 days.

(21) Appl. No.: 15/552,139

(22) PCT Filed: Mar. 7, 2016

(86) PCT No.: PCT/CA2016/050243

§ 371 (c)(1),
(2) Date: Aug. 18, 2017

(87) PCT Pub. No.: WO2016/141471

PCT Pub. Date: Sep. 15, 2016

(65) Prior Publication Data

US 2018/0042796 A1 Feb. 15, 2018

Related U.S. Application Data

(60) Provisional application No. 62/129,258, filed on Mar. 6, 2015.

(51) Int. Cl.
*A61G 5/10* (2006.01)

(52) U.S. Cl.
CPC ..... *A61G 5/101* (2013.01); *A61G 5/1018* (2013.01); *A61G 5/1035* (2013.01)

(58) Field of Classification Search
CPC ..... A61G 5/101; A61G 5/1018; A61G 5/1035
USPC ..... 188/2 F
See application file for complete search history.

(56) References Cited

U.S. PATENT DOCUMENTS 4,560,033 A 12/1985 Dewoody et al.
4,570,756 A * 2/1986 Minnebraker ..... A61G 5/1018 188/2 F
4,805,931 A * 2/1989 Slasor ..... A61G 5/08 280/250.1
4,887,830 A 12/1989 Fought et al.
(Continued)

*Primary Examiner* — Thomas J Williams
*Assistant Examiner* — Mariano Sy
(74) *Attorney, Agent, or Firm* — Norton Rose Fulbright Canada LLP

(57) ABSTRACT

A brake system for a wheelchair comprises a lever assembly adapted to be movably connected to a wheelchair frame, the lever assembly having a handle portion for hand manipulation. A brake unit is adapted to be pivotally connected to relative to the wheelchair frame, the brake unit having a brake end adapted to contact the wheel. An actuator portion and a follower portion are in the brake system, the follower portion cooperating with the actuator portion for the brake unit to be selectively displaceable between at least two configurations, including a floating configuration in which the brake end contacts the wheel so as to automatically pivot into blocking contact with the wheel when the wheel rotates rearwardly, while allowing a forward rotation of the wheel, and a locking configuration in which the brake end is manually locked into blocking contact with the wheel.

16 Claims, 9 Drawing Sheets

(56) References Cited

U.S. PATENT DOCUMENTS

| | | | | | |
|---|---|---|---|---|---|
| 4,987,978 | A * | 1/1991 | Jungersen | A61G 5/1018 | 188/2 F |
| 5,355,977 | A * | 10/1994 | Kuschall | A61G 5/1018 | 188/2 F |
| 5,472,066 | A * | 12/1995 | Schillo | A61G 5/1018 | 188/2 F |
| 6,035,975 | A * | 3/2000 | Loewenthal | A61G 5/1018 | 188/2 F |
| 6,443,268 | B1 * | 9/2002 | Dearth | A61G 5/1018 | 188/2 F |
| 6,520,526 | B2 * | 2/2003 | Amirola | A61G 5/1018 | 188/2 F |
| 6,655,503 | B1 * | 12/2003 | Moody | A61G 5/10 | 188/2 F |
| 6,929,100 | B2 * | 8/2005 | Tanksley | B60T 1/005 | 188/2 F |
| 7,380,642 | B2 * | 6/2008 | Muller | A61G 5/02 | 188/2 F |
| 8,381,883 | B2 * | 2/2013 | Lo | F16D 49/00 | 188/2 F |
| 8,628,108 | B2 * | 1/2014 | Gingras | A61G 5/08 | 280/42 |

* cited by examiner

BRAKE SYSTEM FOR WHEELCHAIR

TECHNICAL FIELD

The present application relates to wheelchairs and, more particularly, to a brake system of the type used to block or brake a wheel of a wheelchair from turning.

BACKGROUND OF THE ART

Wheelchairs are commonly provided with a brake system, also known as a wheel-blocking system that blocks a wheel from turning in specific instances. Such brake systems have a brake component that against the wheel such that, when the wheelchair is biased rearwardly because of sloped terrain, the brake will increase its contact with the wheel and, in doing so, will block the wheel from rotating backward. This feature may be known as a grade aid. Other brake systems simply have a lever that applies a brake component on the wheel to prevent it from rotating, when desired, in similar fashion to a vehicles hand brake.

SUMMARY

Therefore, in accordance with the present disclosure, there is provided a brake system for a wheelchair comprising: a lever assembly adapted to be movably connected to a wheelchair frame, the lever assembly having a handle portion for hand manipulation; a brake unit adapted to be pivotally connected to relative to the wheelchair frame, the brake unit having a brake end adapted to contact the wheel; an actuator portion and a follower portion in the brake system, the follower portion cooperating with the actuator portion for the brake unit to be selectively displaceable between at least two configurations, including a floating configuration in which the brake end contacts the wheel so as to automatically pivot into blocking contact with the wheel when the wheel rotates rearwardly, while allowing a forward rotation of the wheel, and a locking configuration in which the brake end is manually locked into blocking contact with the wheel.

Further in accordance with the present disclosure, the actuator portion is a actuator pin at an end of the lever assembly.

Still further in accordance with the present disclosure, at least one roller bearing supports the actuator pin in the lever assembly.

Still further in accordance with the present disclosure, the follower portion is a follower groove in a body of the brake unit, the follower groove receiving the actuator portion.

Still further in accordance with the present disclosure, the follower groove has a receptacle for captive engagement of the actuator portion in the locking configuration of the brake system.

Still further in accordance with the present disclosure, the follower portion cooperates with the actuator portion for the brake unit to be selectively displaceable to a bypass configuration in which the brake end is held away from the wheel.

Still further in accordance with the present disclosure, the follower groove has a receptacle for captive engagement of the actuator portion in the bypass configuration of the brake system.

Still further in accordance with the present disclosure, an indexing mechanism blocks movement of the lever assembly relative to the wheelchair frame in the at least two configurations.

Still further in accordance with the present disclosure, the indexing mechanism has a biasing ball biased against the lever assembly.

Still further in accordance with the present disclosure, the follower portion cooperates with the actuator portion for the brake unit to be selectively displaceable to a bypass configuration in which the brake end is held away from the wheel.

Still further in accordance with the present disclosure, a spring biasing the brake unit against the wheel in the floating configuration.

Still further in accordance with the present disclosure, a structural member to which the lever assembly and the brake unit are pivotally connected.

Still further in accordance with the present disclosure, the structural member is configured to be releasably fixed to the wheelchair frame by at least one clamp.

Still further in accordance with the present disclosure, the follower portion is a follower groove in a body of the brake unit, the follower groove receiving the actuator portion, wherein the brake system has calibration configuration in which the brake end is displaceable with said structural member to a predetermined visual position relative to the wheel when the actuator portion is at a passageway entering the follower groove.

Still further in accordance with the present disclosure, a wheelchair comprises a frame; wheels rollingly mounted to the frame; and at least one of the brake system as described above.

Still further in accordance with the present disclosure, two of the brake system with one said brake system for each of two rear wheels of the wheelchair, the two brake systems being mirror images of one another.

DETAILED DESCRIPTION

Figure 1:
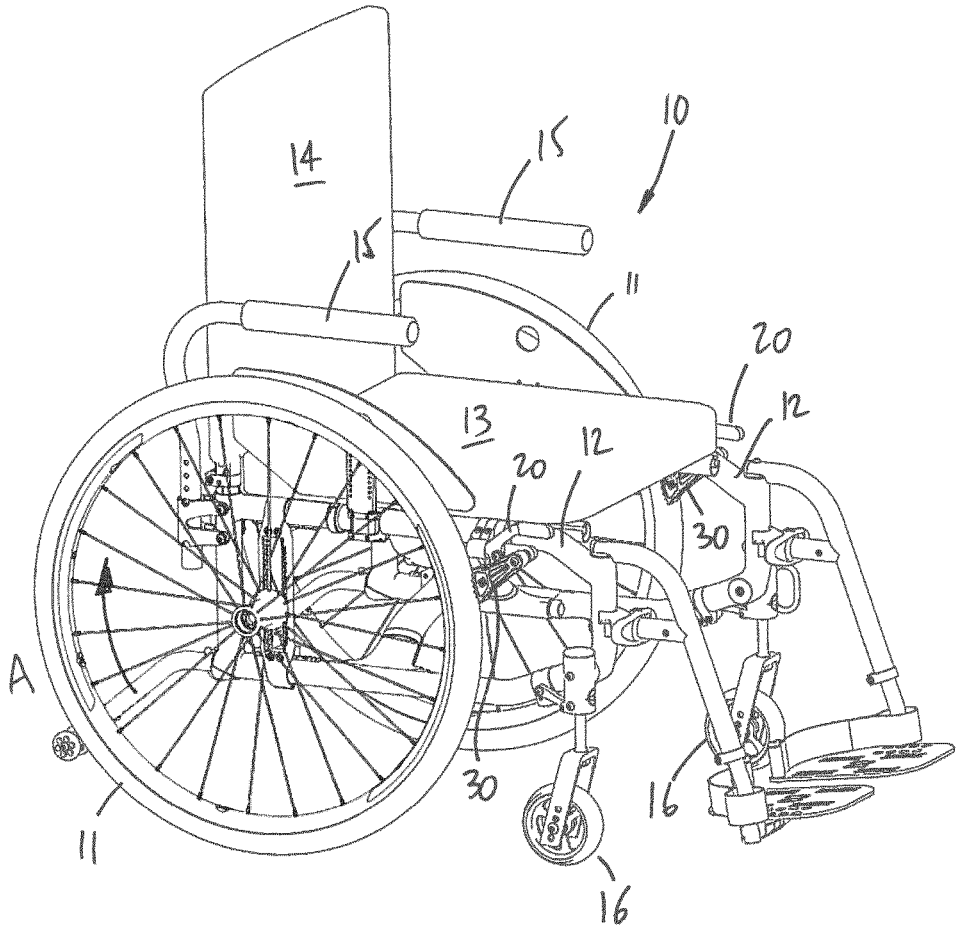
FIG. 1 is a perspective view of a wheelchair featuring a brake system in accordance with the present disclosure.

Referring to the drawings and, more particularly, to FIG. 1, a brake system for wheelchair is generally illustrated as being mounted to the wheelchair 10. The wheelchair 10 has wheels 11 and a tubular frame member 12 being part of the frame of the wheelchair 10. While not described in full detail, the wheelchair 10 is of the type having a frame interfacing the wheels 11 to a seat 13, a backrest 14, armrests 15 and/or front casters 16, among other components. For clarity, the rolling direction of the wheel 11 in a forward movement of the chair is illustrated by A.

The brake system is configured to automatically block the wheel from turning backward in a rearward gravity situation (hereinafter, a gravity situation), i.e., when the wheelchair is biased rearwardly because of sloped terrain or simply when rotating in a direction opposite to A. The brake system is also to be used in a handbrake-like manner, to block the wheel 11 from turning when the user so chooses. A single one of the brake system is required on the wheelchair 10, as the blocking of a single one of the wheels 11 may be sufficient to prevent movement of the wheelchair 10. However, as shown in FIG. 1, a pair of the brake system may be used, i.e., one per wheel, to ensure a more uniform behavior of the wheelchair 10. For example, in a gravity situation or in a park braking situation, it may be desired to block both wheels, with the brake systems being for instance mirror images of one another. For clarity, the expression "brake" is used, and is meant to cover the action of blocking or locking the wheel 11 from turning.

Figure 2:
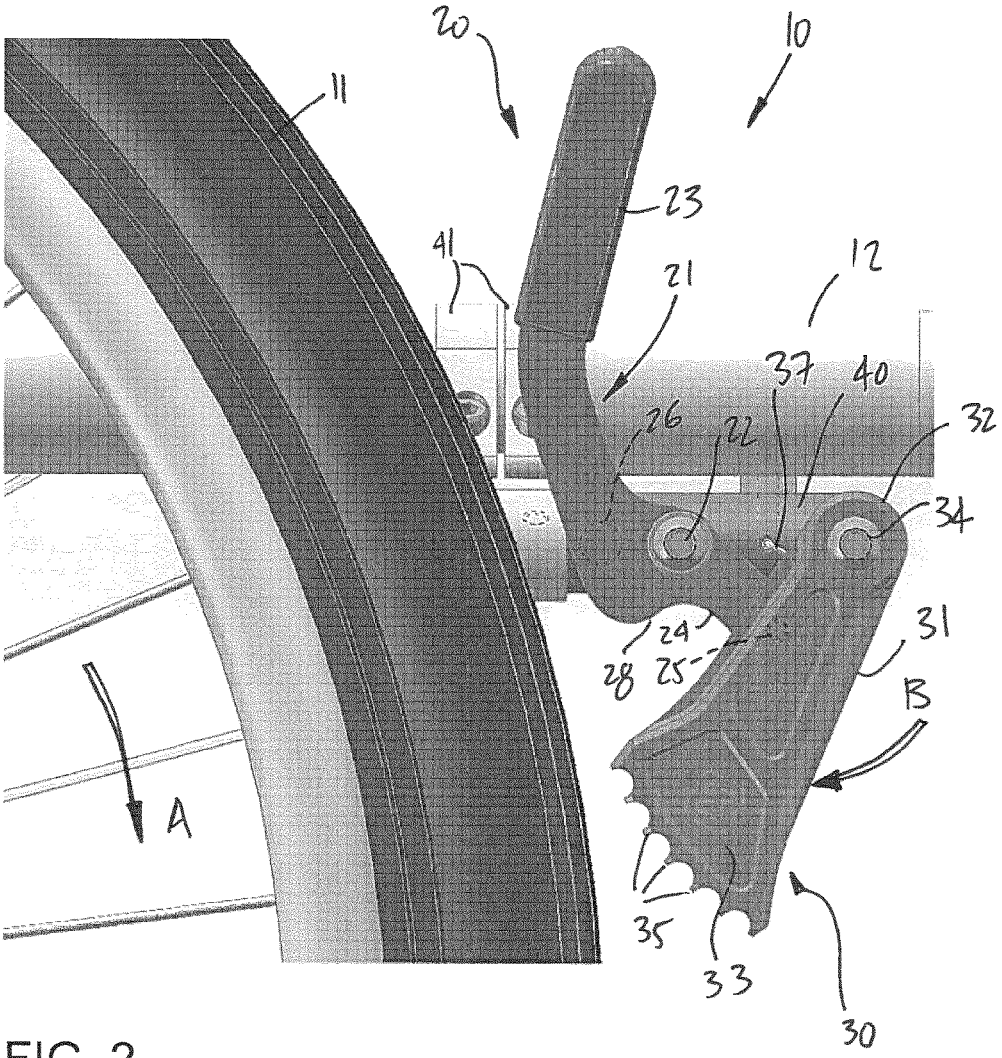
FIG. 2 is a side view of the brake system for wheelchair of FIG. 1, in a bypass configuration.

The brake system has a lever assembly 20, a brake unit 30, and may include a structural member 40 (forming a structure of the brake system). Alternatively, the structural member may be one of the tubular frame member 12 part of the wheelchair 10, in which case the lever assembly 20 and the brake unit 30 are connected to the wheelchair 10 as opposed to including their structural member 40. The lever assembly 20 and the brake unit 30 act concurrently to enable different configurations of the brake system, which configurations are set by the user of the wheelchair 10:

FIG. 2 shows a bypass or free configuration. In the bypass configuration, the brake unit 30 is kept away from the wheel 11 and is therefore inactive. The bypass configuration may or may not be provided by the brake system.

Figure 3:
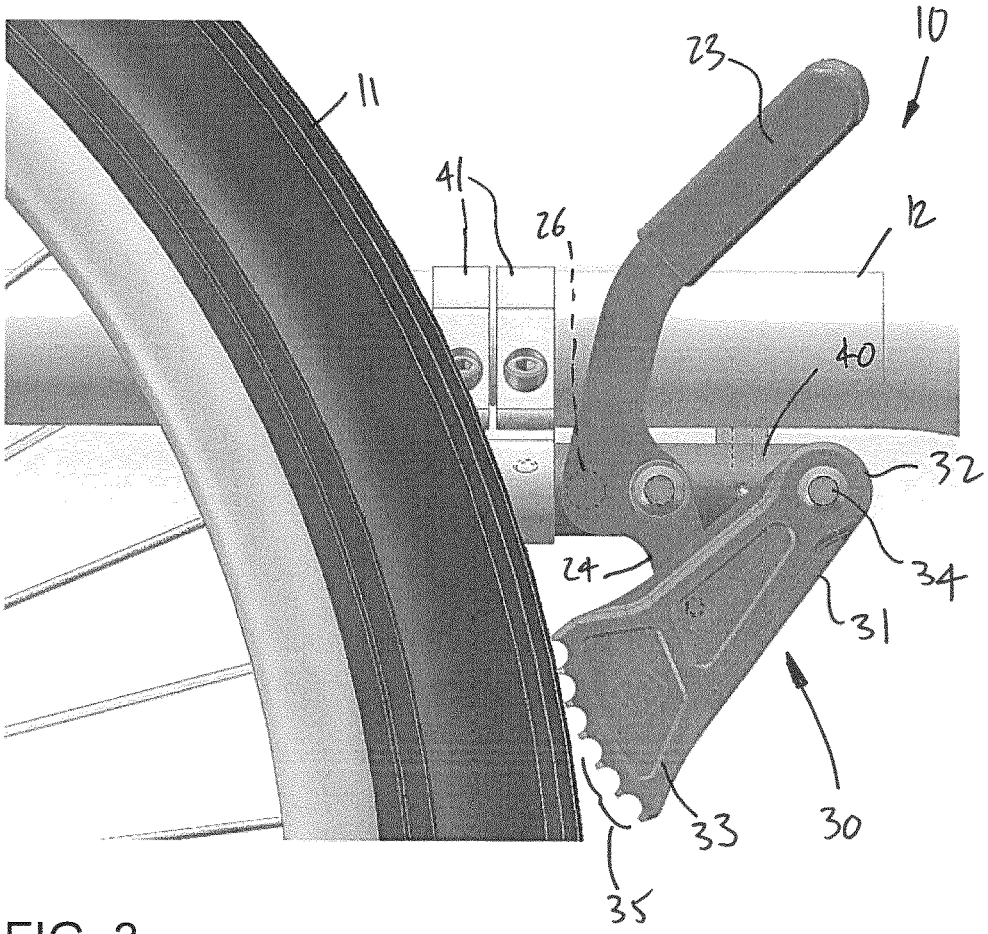
FIG. 3 is a side view of the brake system for wheelchair of FIG. 1, in a floating configuration.

In FIG. 3, the brake unit 30 is held by the lever assembly 20 in a floating configuration, also known as a grade aid or gravity aid configuration. The floating configuration is used for the brake unit 30 to block backward movement of the wheel 11 in the event of a gravity situation or backward movement. In such a case, the brake unit 30 automatically increases its contact with the wheel 11 into blocking contact with the wheel 11. In the floating configuration, the wheel 11 is free to rotate in a forward movement of the wheelchair 10, the brake unit 30 opposing little resistance.

Figure 4:
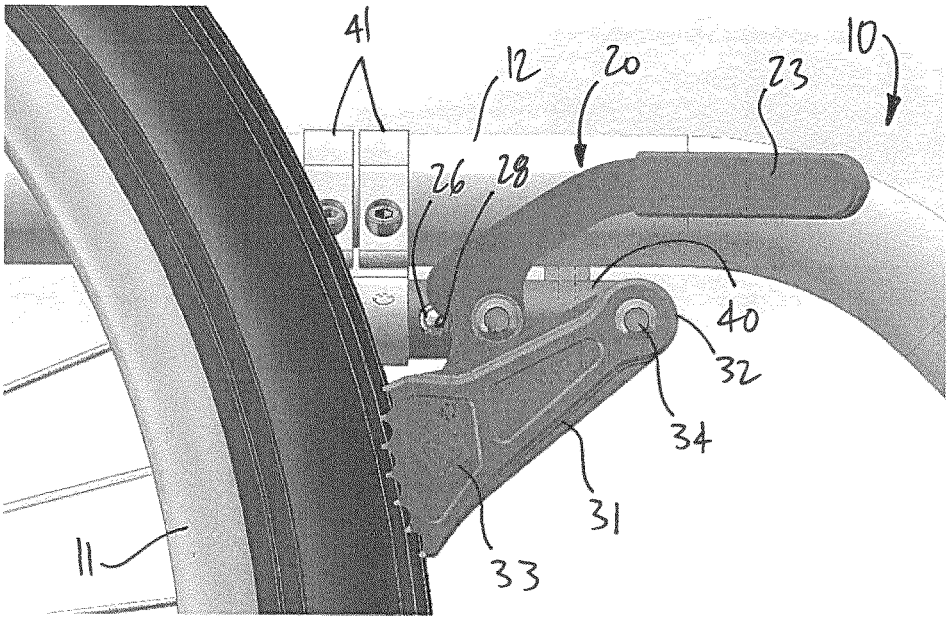
FIG. 4 is a side view of the brake system for wheelchair of FIG. 1, in a locking configuration.

In FIG. 4, there is illustrated a locking configuration (a.k.a., park braking configuration) by which the brake unit 30 is urged against the wheel 11 by the lever assembly 20 to block the wheel 11 from turning in either direction. This is a handbrake feature of the brake assembly of the present disclosure as the brake is activated by way of a hand lever as desired by the user.

Figure 9:
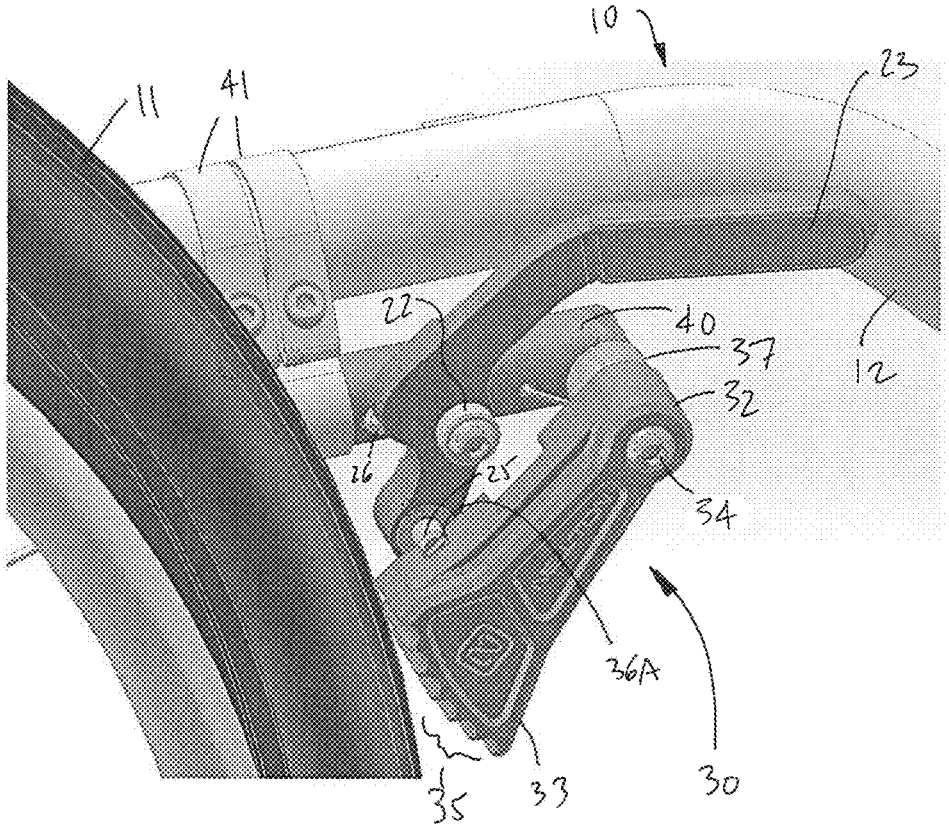
FIG. 9 is a side view of the brake system for wheelchair of FIG. 1, in a calibration configuration.

In FIG. 9, there is illustrated a calibration configuration, used during installation of the brake system along the wheelchair frame. In the calibration configuration, the brake unit 30 may slightly touch the wheel 11. As described below, the calibration configuration is an indicative position used to guide a user in installing the brake system properly, for subsequent use of the floating configuration of FIG. 3 and the locking configuration of FIG. 4.

Figure 5:
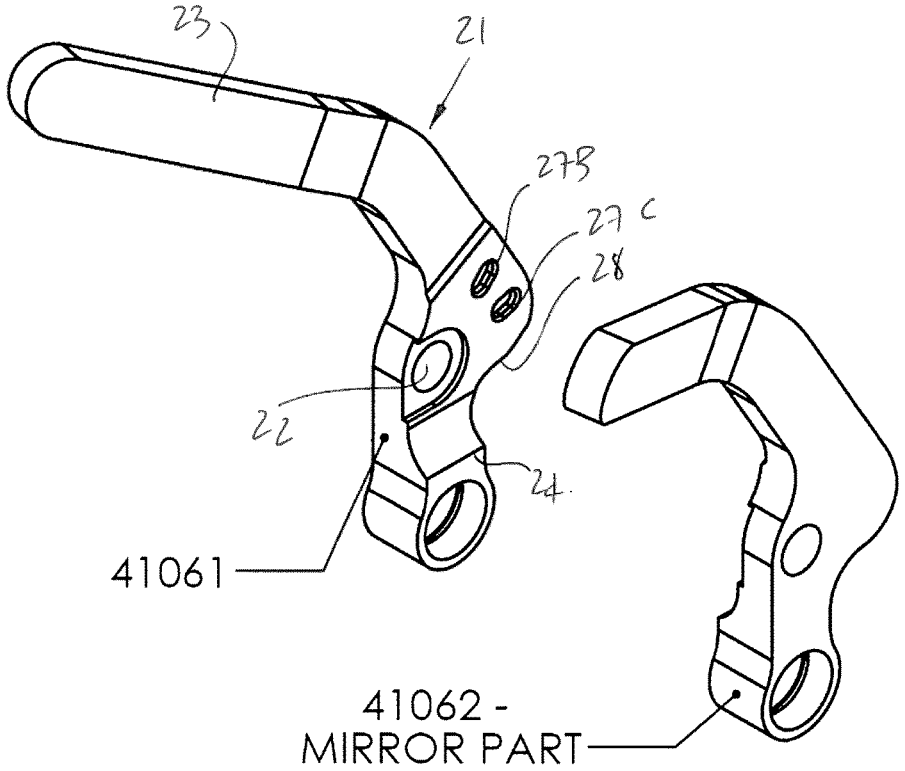
FIG. 5 is a perspective view of a pair of lever bodies of a lever assembly of the brake system of FIG. 1.

Referring concurrently to FIGS. 1 to 5, the lever assembly 20 is shown. The lever assembly 20 has a lever body 21 shown on its own in FIG. 5. FIG. 5 represents two of the lever bodies 21, although the brake system features a single one of the lever body 21. The lever bodies 21 are shown as being mirror images of one another, and the one of the mirror images selected is based on the side of the wheelchair 10 upon which the lever assembly 20 is mounted.

Figure 6:
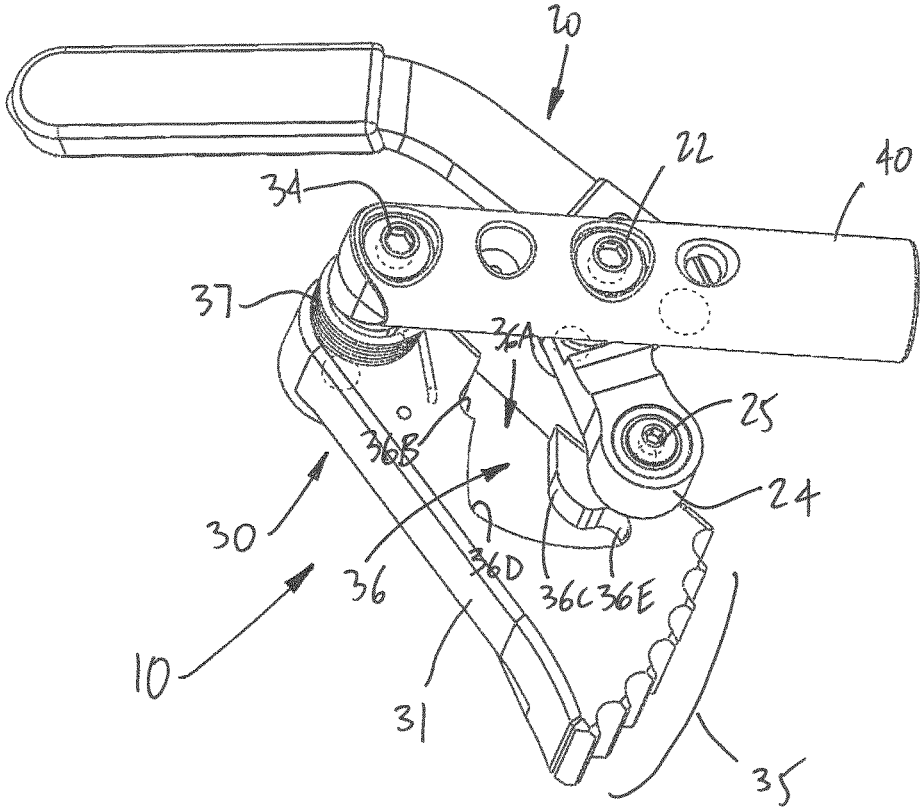
FIG. 6 is an enlarged perspective view of the brake system of FIG. 1.
Figure 7:
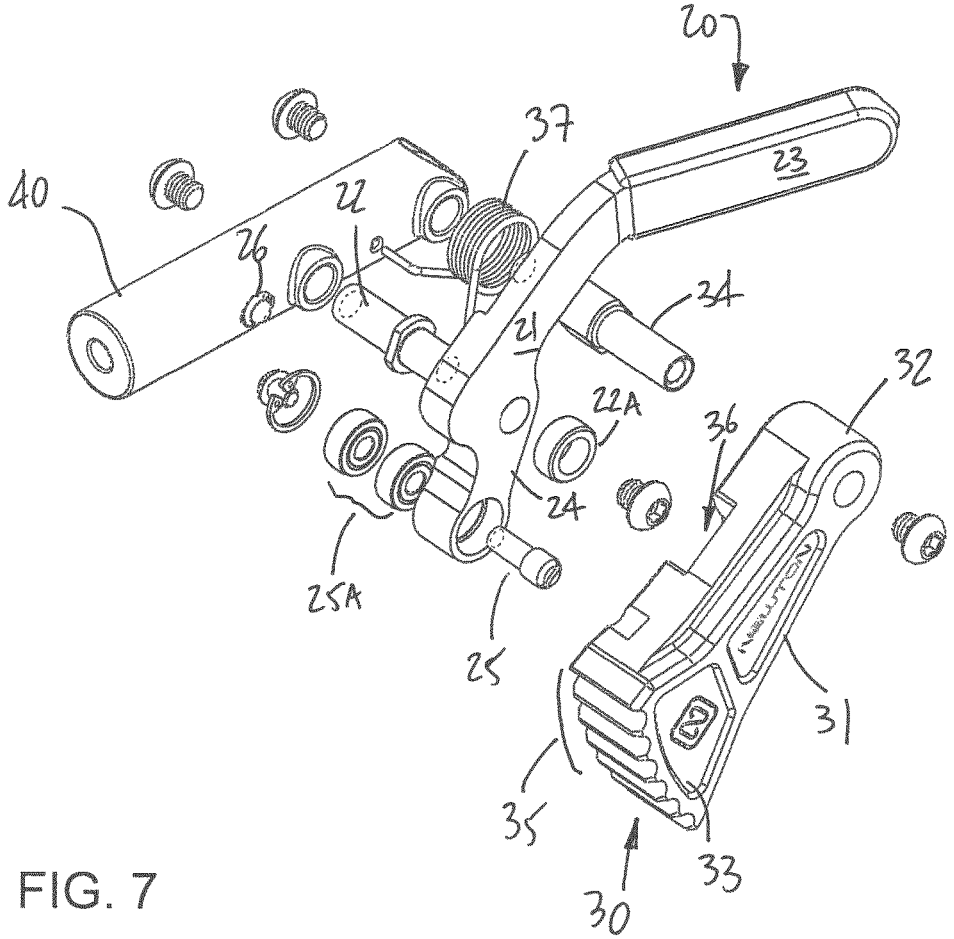
FIG. 7 is an assembly view of brake system of FIG. 1.

As shown in FIG. 7, the lever body 21 is connected to the tubular frame member 40 by way of a pivot 22, although it is considered to mount the lever body 21 to the member 40 for translation instead of rotation. The pivot 22 may include a fastener such as a bolt with hexagonal socket, among numerous possibilities, as well as a low-friction bearing sleeve 22A to allow a rotation of the lever body 21 relative to the tubular frame member 40. Although not illustrated in FIG. 7, it is contemplated to use roller bearings or the like to support the pivot 22 and allow its rotation relative to the frame member 40. Referring concurrently to FIGS. 5-7, on one side of the pivot 22, the lever body 21 has a handle end 23 that is the hand interface of the lever body 21, by which the user may select the configuration of the brake system. The handle end 23 may be ergonomically positioned to face away from the seat 13 of the wheelchair 10 (FIG. 1) such that the brakes are applied with a pulling action. At an opposite end of the pivot 22, the lever body 21 has an actuator end 24. The actuator end 24 has an actuator pin 25 (also known as a guide or guide pin) projecting from its plane, the actuator pin 25 being the interface of the brake with the brake unit 30, as described hereinafter. As shown in FIG. 7, the actuator pin 25 may be supported by roller bearing(s) 25A to favor its rotation.

The lever assembly 20 also comprises an indexing mechanism by which the lever assembly 20 will be releasably locked in any one of the three configurations of FIGS. 2, 3 and 4. The indexing mechanism is constituted of a biased ball 26 that projects outwardly from a surface of the tubular frame member 12 and is biased outwardly, for example by a biasing spring. The biased ball 26 cooperates with slots 27B and 27C shown in FIG. 5 as well as with shoulder 28. Accordingly, a rotation of the lever body 21 relative to the pivot 22 by way of hand actuation by a user of the wheelchair 10 will result in retraction of the biased ball 26 between slots 27B, 27C and against the shoulder 28 as shown in FIG. 4. In these discrete positions, the lever body 21 is held captive unless manually dislodged by a user.

Referring concurrent to FIGS. 1 to 4, 6 and 7, the brake unit 30 is shown as having a brake body 31. The brake body 31 may be a monolithic piece having a pivot end 32 and a brake end 33. The brake body 31 is pivotally connected at its pivot end 32 by a pivot 34 to the tubular frame member 40 although it is considered to mount the lever body 21 to the member 40 for translation instead of rotation. Again, the pivot 34 may be any fastener such as bolt with hexagonal socket or any other configuration, for instance, with or without bearings, for the brake body 31 to rotate about the pivot 34. The brake end 33 is the part of the brake unit 30 that comes in contact with the wheel 11 and more specifically with the tire in the instant embodiment, when braking is desired. In the illustrated embodiment, the brake end 33 may have a plurality of fingers 35 that provide some purchase to the brake body 31 when against the tire of the wheel 11. Other interface surfaces may be used instead of the fingers 35, such as smooth surfaces, continuous surfaces, etc.

As seen in FIG. 6, a follower groove 36 is defined in the brake body 31. The follower groove 36 receives therein the actuator pin 25 of the lever assembly 20 in such a way that the lever assembly 20 will guide the brake unit 30 into one of the three configurations of FIGS. 2 to 4. A biasing spring 37 may also be used to bias the brake unit 30 in direction B. The action of the biasing spring 37 may hence ensure that the brake unit 30 is urged into contact with the wheel 11 in the floating configuration. It is however considered to employ the brake unit 30 without the biasing spring 37. As an example, the brake unit 30 may be positioned so as to be naturally biased by gravity into direction B.

As suggested previously, the lever assembly 20 and the brake unit 30 may be mounted directly to the frame of the wheelchair 10. However, the use of the structural member 40 is contemplated as it facilitates the retrofitting of a brake assembly on the wheelchair 10, without the necessity of making holes in the frame of the wheelchair 10. Also, clamps 41 (FIG. 2) may be used to fix the structural member 40 to the tubular frame member 12 of the wheelchair 10, and hence allow a translational adjustment of the position of the brake system along the tubular frame member 12. If the tubular member 12 is of circular section, a rotational adjustment may also be possible. This feature can be used to make sure the brake system is adequately positioned relative to the wheel 11. For example, the brake system may have a calibration configuration as shown in FIG. 9. In an example of the calibration configuration, the actuator pin 25 is at the entry of the follower groove 36, i.e., in a visually distinct and reproducible position. In parallel, the brake system is configured such that, if in the calibration configuration and the brake unit 30 slightly contacts the wheel 11, then the brake system is in the right position for the brake system to operate properly in the floating configuration and in the locking configuration. This is an advantageous feature in that the user need not try the brake system to determine if the floating configuration is functional.

Now that the various components of the brake system have been described, an operation of the brake system in relation to the configurations of FIGS. 2-4 is set forth.

As observed from FIG. 6 and FIGS. 8A to 8E, the follower groove 36 has various portions illustrated as 36A to 36E. As seen in FIGS. 5 and 6A, a passageway 36A opens to a side of the brake body 31, and is the pathway that will be taken by the actuator pin 25 to exit and penetrate the follower groove 36. When in the follower groove 36, the actuator pin 25 may rotate against a perimeter of the groove 36 instead of sliding against it. This passageway 36A is provided as a safety feature to avoid situations in which one's finger(s) is caught between the wheel 11 and the brake unit 30. Moreover, the passageway 36A may be part of the calibration configuration (FIG. 9), in that the calibration configuration is reached when the actuator pin 25 is in the passageway 36A.

As seen in FIG. 6 and FIGS. 8A to 8E, a release receptacle 36B faces the passageway 36A. In the release configuration, the actuator pin 25 of the lever assembly 20 is received in the release receptacle 36B as in FIG. 6B. The lever assembly 20, on the other hand, is the indexed orientation with the biased ball 26 inserted in the slot 27B. When the actuator pin 25 is in the release receptacle 36B as in FIG. 6B, the brake unit 30 is in the bypass configuration of FIG. 2.

Figures 8A, 8B, 8C, 8D, 8E:
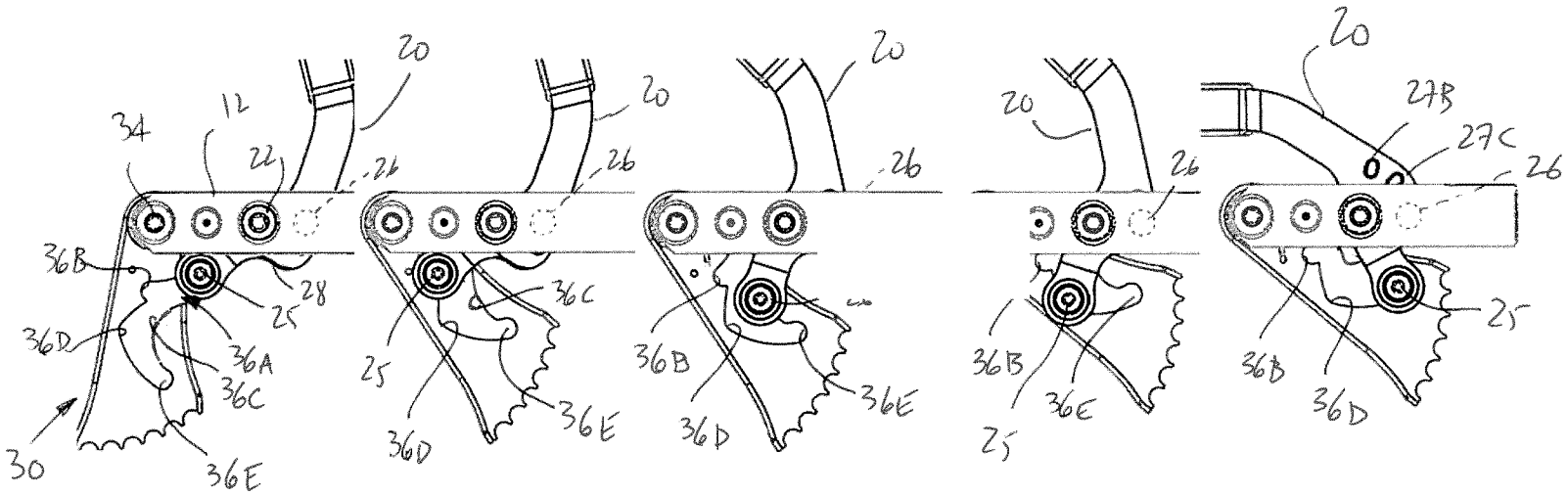
FIGS. 8A to 8E show an interaction of the lever assembly and a brake unit of the brake system of FIG. 1, in the various configurations.

A floating ramp 36C opposes the actuator pin 25 of the lever assembly 20 when the brake unit is in the floating configuration of FIG. 3 and FIG. 8C. In the floating position, the lever assembly 20 is in the indexed orientation with the biased ball 26 inserted in the slot 27C, as a result of manipulation of the lever assembly 20 by the user of the wheelchair 10. In the floating position, the brake end 35 is in slight contact with the tire of the wheel 11 and rubs slightly against the tire. However, this slight contact will not prevent the wheel 11 from rotating in direction A (FIG. 1) for the wheelchair 10 to move forward. The actuator pin 25 may therefore move freely between the ramp 36C and the gravity brake receptacle 36D in the floating configuration of the brake unit 30.

However, in a gravity situation or in backward movement, the brake unit 30 is entrained into further contact with the tire of the wheel 11 to block its backward rotation (when the orientation of FIG. 8C entails a slight rub). In this case, the brake unit 30 will pivot due to the contact with the tire of the wheel 11 and may ultimately reach the gravity brake receptacle 36D as in FIG. 8D, the gravity brake receptacle 36D delimiting the pivoting movement of brake unit 30 in the floating configuration and thus acting as a stop if necessary. Accordingly, whether the wheelchair 10 is blocked in a gravity situation or returned to forward movement, the brake unit 30 will pivot between these positions, due to the movement delimiting interaction between the actuator pin 25, the floating ramp 36C and the gravity brake receptacle 36D, with the actuator pin 25 remaining fixed as the biased ball 26 is in the slot 27C. when the wheelchair 10 moves forward from the gravity situation.

Finally, a lock receptacle 36E receives the actuator pin 25 when the brake unit 30 is in the locking configuration of FIGS. 4 and 8E. When the brake unit 30 is in the locking configuration, the lever assembly 20 is held captive by the biased ball 26 in abutment with the shoulder 28. By the concurrent action of the biased ball 26 applying pressure on the shoulder 28 as in FIG. 6 and the actuator pin 25 held captive in the lock receptacle 36E, the brake unit 30 will be held captive to block both rotations of the wheel 11. However, the action need not be concurrent, as the shape of the lock receptacle 36E may suffice in keeping the brake unit 30 captive in the locking configuration.

Accordingly, the brake system of the present disclosure enables both types of braking actions, namely the braking in a gravity situation, and the handbraking, and may if desired have the inactive state. The configurations of the brake system are decided by the user of the wheelchair 10, via a pulling or pushing manipulation of the lever assembly 20 of the brake system, between the three indexed orientations of the lever assembly 20.

Modifications and improvements to the above-described embodiments of the present invention may become apparent to those skilled in the art. The foregoing description is intended to be exemplary rather than limiting. For example, the indexing mechanism may have other configurations, for instance by having the biased component, whether it be a ball or other, be in the lever assembly in the lever body 21 as opposed to in the frame 40. It is also contemplated to have the biasing spring 37 and adapted groove provide sufficient force for maintaining the block 30 in the selected configurations position without the need for the indexing mechanism of the lever assembly 20. As yet another alternative, the pin or actuator may be part of the brake unit 30, while the follower portion, such as a follower groove, may be part of the lever assembly 20. It is also contemplated to provide a translational degree of freedom for the lever assembly 20 in addition or as an alternative to the pivot 22, with appropriate arrangements made to the follower portion of the brake unit 30 as a consequence. As yet another alternative, the brake unit 30 may contact the rim of the wheel 11, or any other part thereof, instead of contacting the tire. The scope of the present invention is therefore intended to be limited solely by the scope of the appended claims.

The invention claimed is:

1. A brake system for a wheelchair comprising:

a lever assembly adapted to be movably connected to a wheelchair frame, the lever assembly having a handle portion for hand manipulation;

a brake unit adapted to be pivotally connected to relative to the wheelchair frame, the brake unit having a brake end adapted to contact the wheel;

an actuator portion and a follower portion in the brake system, the actuator portion having a projecting interface, the follower portion having a groove receiving the projecting interface of the actuator portion for the brake unit to be selectively displaceable between at least two configurations, as a response to movements of the lever assembly, each of the at least two configurations caused by a cooperation between the projecting interface and the groove, of the at least two configurations including a floating configuration in which the brake end contacts the wheel so as to automatically pivot into blocking contact with the wheel when the wheel rotates rearwardly, while allowing a forward rotation of the wheel, and a locking configuration in which the brake end is manually locked into blocking contact with the wheel.

2. The brake system according to claim 1, wherein the projecting interface of the actuator portion is an actuator pin at an end of the lever assembly.

3. The brake system according to claim 2, further comprising at least one roller bearing supporting the actuator pin in the lever assembly.

4. The brake system according to claim 1, wherein the follower portion is the follower groove in a body of the brake unit, the follower groove receiving the projecting interface of the actuator portion.

5. The brake system according to claim 4, wherein the follower groove has a receptacle for captive engagement of the actuator portion in the locking configuration of the brake system.

6. The brake system according to claim 4, wherein the follower portion cooperates with the actuator portion for the brake unit to be selectively displaceable to a bypass configuration in which the brake end is held away from the wheel.

7. The brake system according to claim 6, wherein the follower groove has a receptacle for captive engagement of the actuator portion in the bypass configuration of the brake system.

8. The brake system according to claim 4, further comprising an indexing mechanism blocking movement of the lever assembly relative to the wheelchair frame in the at least two configurations.

9. The brake system according to claim 8, wherein the indexing mechanism has a biasing ball biased against the lever assembly.

10. The brake system according to claim 1, wherein the follower portion cooperates with the actuator portion for the brake unit to be selectively displaceable to a bypass configuration in which the brake end is held away from the wheel.

11. The brake system according to claim 1, further comprising a spring biasing the brake unit against the wheel in the floating configuration.

12. The brake system according to claim 1, further comprising a structural member to which the lever assembly and the brake unit are pivotally connected.

13. The brake system according to claim 12, wherein the structural member is configured to be releasably fixed to the wheelchair frame by at least one clamp.

14. The brake system according to claim 12, wherein the follower portion is a follower groove in a body of the brake unit, the follower groove receiving the actuator portion, wherein the brake system has calibration configuration in which the brake end is displaceable with said structural member to a predetermined visual position relative to the wheel when the actuator portion is at a passageway entering the follower groove.

15. A wheelchair comprising:

a frame;

wheels rollingly mounted to the frame; and at least one of the brake system described in claim 1.

16. The wheelchair according to claim 15, comprising two of the brake system with one said brake system for each of two rear wheels of the wheelchair, the two brake systems being mirror images of one another.

* * * * *